US007323809B2

(12) United States Patent
Küpper et al.

(10) Patent No.: US 7,323,809 B2
(45) Date of Patent: Jan. 29, 2008

(54) LAMP EMITTING VISIBLE AND IR LIGHT

(75) Inventors: Lukas Küpper, Aachen (DE); Josef Andreas Schug, Würselen (DE); Rolf Gervelmeyer, Geilenkirchen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 2 days.

(21) Appl. No.: 10/521,852

(22) PCT Filed: Jul. 14, 2003

(86) PCT No.: PCT/IB03/03236

§ 371 (c)(1),
(2), (4) Date: Jan. 21, 2005

(87) PCT Pub. No.: WO2004/010048

PCT Pub. Date: Jan. 29, 2004

(65) Prior Publication Data

US 2005/0236960 A1 Oct. 27, 2005

(30) Foreign Application Priority Data

Jul. 23, 2002 (DE) ..... 102 33 328
Oct. 15, 2002 (DE) ..... 102 47 983

(51) Int. Cl.
*H01J 61/40* (2006.01)

(52) U.S. Cl. ..... 313/112; 313/111; 313/115

(58) Field of Classification Search ..... 313/112–114, 313/111, 115; 362/609
See application file for complete search history.

(56) References Cited

U.S. PATENT DOCUMENTS

| | | | | |
|---|---|---|---|---|
| 2,945,146 | A | 7/1960 | Meyer | |
| 3,688,147 | A * | 8/1972 | Raago | 313/496 |
| 4,801,845 | A * | 1/1989 | Kiesel | 313/579 |
| 5,111,105 | A | 5/1992 | Yamamoto | |
| 5,525,856 | A | 6/1996 | Kawai et al. | |
| 5,619,102 | A * | 4/1997 | Scholler | 313/635 |
| 5,962,973 | A * | 10/1999 | Rice | 313/580 |
| 6,462,465 | B1 * | 10/2002 | Israel et al. | 313/25 |
| 6,710,363 | B1 * | 3/2004 | Trigiani | 250/504 H |
| 2001/0019482 | A1 * | 9/2001 | Kobayashi et al. | 362/510 |
| 2002/0063503 | A1 | 5/2002 | Tsuda et al. | |
| 2003/0202358 | A1 * | 10/2003 | Albou et al. | 362/510 |
| 2003/0209962 | A1 * | 11/2003 | DAvies et al. | 313/272 |

FOREIGN PATENT DOCUMENTS

| | | |
|---|---|---|
| DE | 10027018 | 12/2001 |
| DE | 10027018 A1 | 12/2001 |
| EP | 0682356 A2 | 11/1995 |
| EP | 0682356 B1 | 11/1995 |
| EP | 0682356 A3 | 2/1996 |

* cited by examiner

*Primary Examiner*—Joseph Williams
*Assistant Examiner*—Hana Asmat Sanei

(57) ABSTRACT

A lamp radiates visible light and infrared light. The lamp bulb of the lamp includes at least a first region which is at least partly permeable to infrared light, and at least partly impermeable to visible light. At least a second region of the bulb is wholly or partly permeable at least to visible light.

7 Claims, 5 Drawing Sheets

LAMP EMITTING VISIBLE AND IR LIGHT

Figure 1:
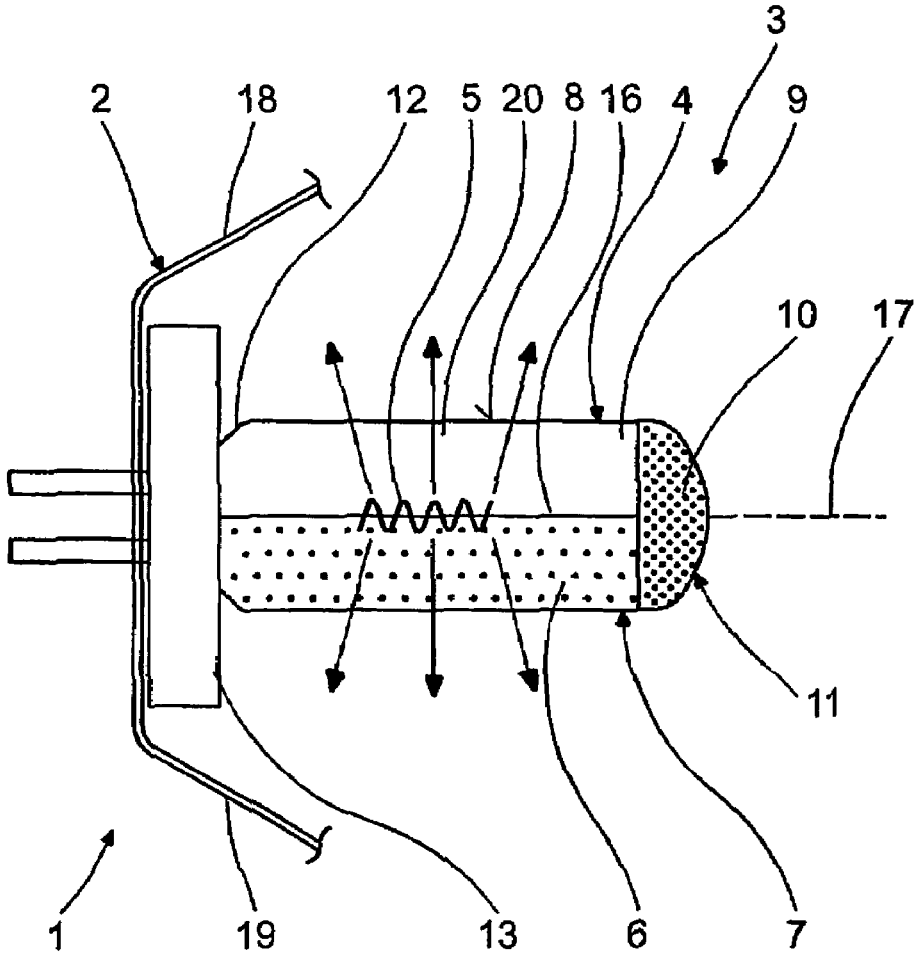

Such a lamp is known as a light source from DE 100 27 018 A1 and is used in a headlight. The vehicle headlight comprises a reflector, a lens, and a screen and operates by the projection principle. Light emitted by the lamp is reflected by the reflector. The screen and the lens are arranged in the radiation path of a reflected light beam. In the "low-beam" operational position, the light beam in the visible wavelength range issuing from the headlight is a low beam illuminating a close range. The screen is at least partly permeable to light in the infrared wavelength range at least locally. The light passing through the screen in the infrared wavelength range is a high beam and irradiates a long-distance range. The long-distance range is registered by a sensor device and presented to the vehicle's driver by means of a display device.

The invention has for its object to provide a simple lamp for illuminating the close range with light in the visible wavelength range and at the same time irradiating a long-distance range with infrared light.

According to one embodiment of the invention, a lamp bulb comprises at least a first region which is at least partly permeable to infrared light and which is at least partly impermeable to visible light, and at least a second region which is wholly or partly permeable at least to visible light. These two regions of the lamp bulb primarily serve to provide the desired light distribution for the lighting installation. Substantially the entire light emission of the lamp is realized through these regions of the lamp bulb. Further regions of the lamp bulb, which do not serve this purpose or in a secondary sense only, are, for example, the region of the pinch. In addition to visible light, the lamp also realizes a defined emission of infrared light, while only integral components of the lamp bulb take part in the filtering of the light issuing from the lamp bulb. As a result the lamp is capable of performing two lighting functions, i.e. for example infrared light for long distance and visible light for short distance. When the lamp or a lighting installation comprising such a lamp is used for this purpose in conjunction with a night vision apparatus or as a component of such an apparatus, which uses at least infrared light functionally, an improvement and enhancement of the field of vision of the user is achieved, while dazzling of persons in the illuminated region is avoided to a very high degree. No essential constructional changes of the lamp bulb are necessary in spite of the added function, i.e. of a filtering function of at least a region of the lamp bulb. A night vision apparatus for a motor vehicle using at least infrared light as part of its function, denoted IR night vision apparatus for short, comprises at least a light source from which at least infrared light enters the desired region, in particularly a region in front of the vehicle and beyond the low-beam region illuminated by visible light. A night vision apparatus in addition comprises an infrared detector or a sensor device which detects the region in front of the vehicle irradiated by the infrared light. An improved monitoring of the region in front of the vehicle is thus made possible by means of a display device, such as a picture screen, which is arranged at eye level for the vehicle's driver.

Advantageously, the first region comprises a filter coating. Such a thin-film filter can be manufactured in a coating process.

In a simple manner, the filter coating forms a semi-circular shell which surrounds the lamp bulb around its lower side and allows only infrared light to enter a lower reflector sector so as to generate an IR high beam.

In a simple manner, the filter coating envelops the bulb, such that the lamp generates exclusively an IR high beam.

In a simple manner, the filter coating envelops one of two incandescent filaments of a dual-filament halogen lamp such that in the low-beam position a low beam formed by light in the visible wavelength range can be generated by a first incandescent filament, and at the same time a high beam formed by light in the infrared wavelength range can be generated by the second incandescent filament.

Advantageously, the filter coating is provided on a shield. The first region of the lamp bulb comprises a shield which is at least partly permeable to infrared light and at least partly impermeable to visible light. If this shield is used in a dual-filament halogen incandescent lamp, and this shield extends below a first filament, then the first filament is active in a first, low-beam situation and radiates light in the visible wavelength range in the form of a low beam, while at the same time an infrared high beam is generated by the same first filament. In a second, high-beam condition, a second incandescent filament is active and radiates light in the visible wavelength range as a high beam.

Advantageously, means are provided on the lamp bulb which safeguard a neutral color impression within a white range. In addition to the filtered infrared light, a red light in the visible wavelength range has also been filtered out undesirably. A purpose-oriented dimensioning and arrangement of a bulb region through which visible light in a blue and/or green wavelength range is issued makes it possible to mix the undesired red light additively with the blue and green light into a white light. The distance range of this white light may be set for a close range, and a neutral color impression of the lighting installation can be achieved.

It is preferred in an embodiment of the invention that means are arranged in the region which is at least permeable to visible light, which means reflect at least partly infrared light into the region which is at least partly permeable to infrared light and wholly or partly impermeable to visible light. The reflected infrared light comprises in particular the wavelength range of the infrared light which is relevant to the IR night vision apparatus.

An intensification of the infrared light radiated through the first region is achieved thereby.

It is furthermore preferred that the light source is constructed as a halogen lamp or as a gas discharge lamp, since said lamp types comply with the requirements of the automobile industry in particular as regards operational reliability, space occupation, and luminous efficacy.

Advantageously, a lamp bulb has at least a first region which is at least partly permeable to UV light and infrared light and is at least partly impermeable to visible light, and at least a second region which is wholly or partly permeable at least to visible light. Should the night vision apparatus fail, i.e. the sensor device or the display device, it is advantageous to supply not only infrared light to the long-distance region, but at the same time also UV light. It is achieved thereby that traffic signs or UV-reflecting materials, for example provided on persons, can be perceived.

Advantageously, such a filter permeable to UV and IR and blocking visible light can be provided on a screen or shutter.

Figure 2:
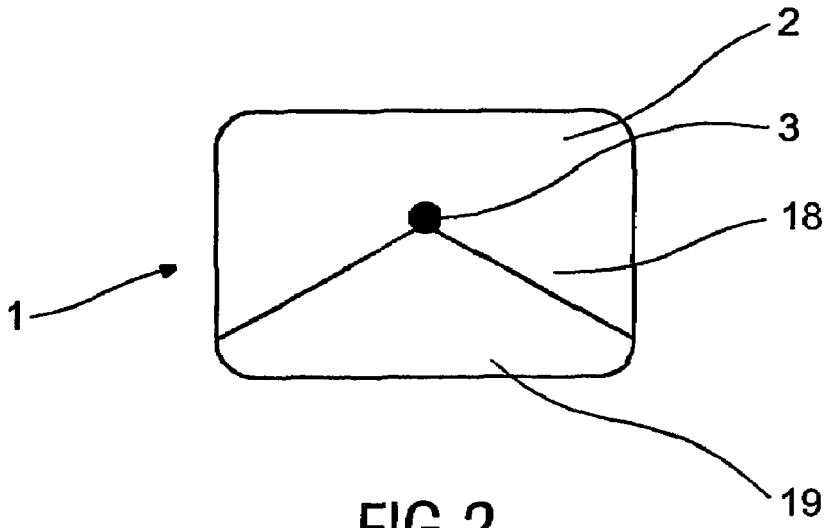
Figure 3:
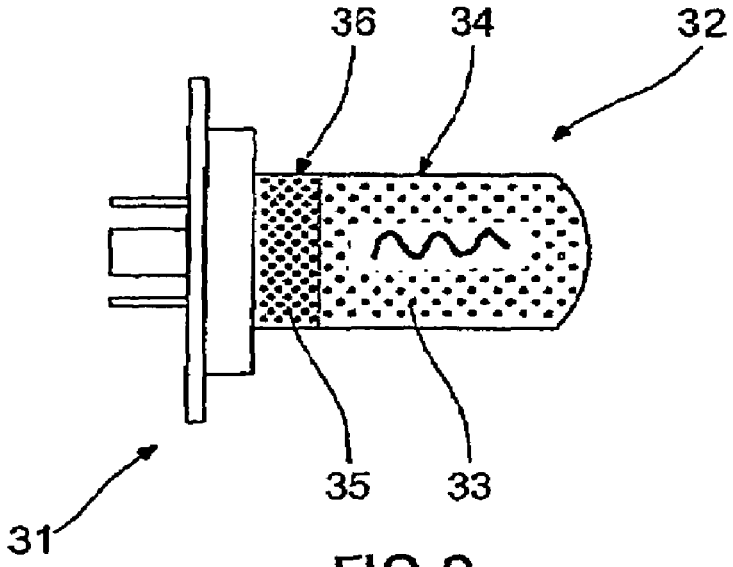
Figure 4:
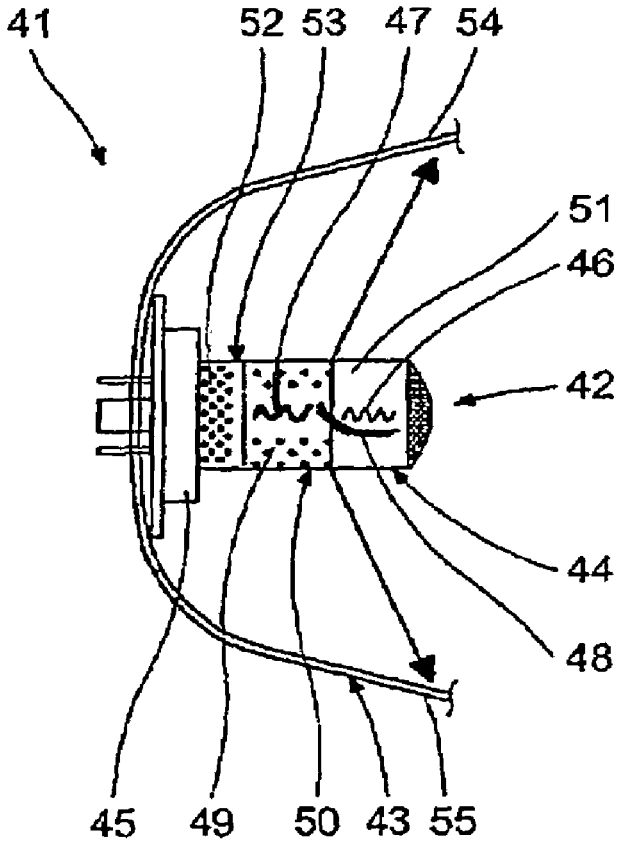
Figure 5:
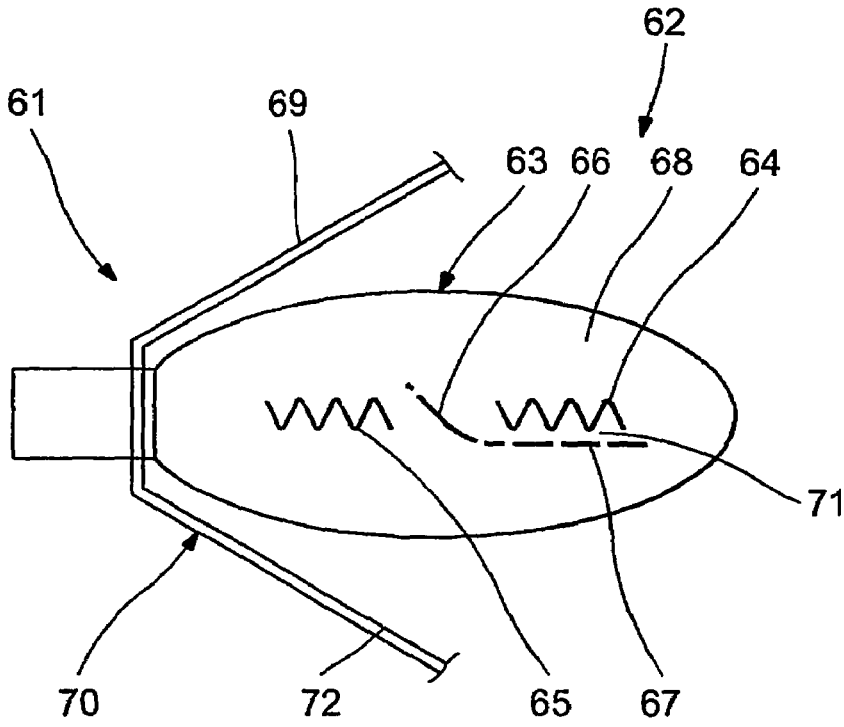
Figure 6:
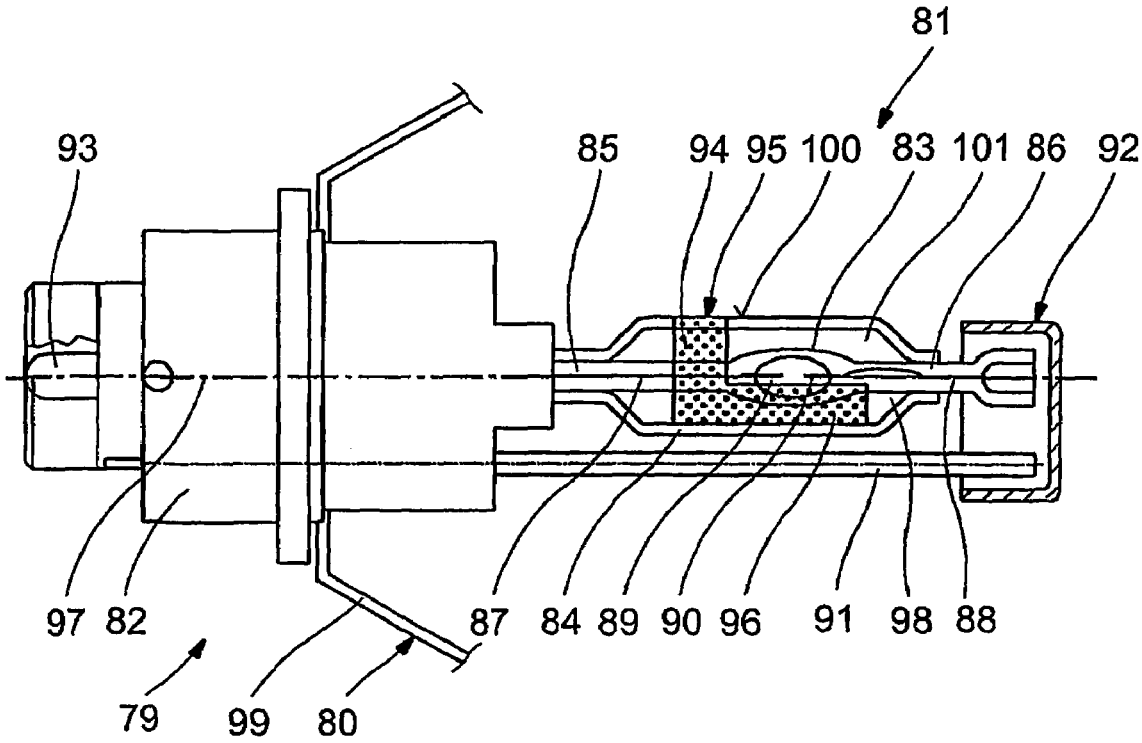
Figure 7:
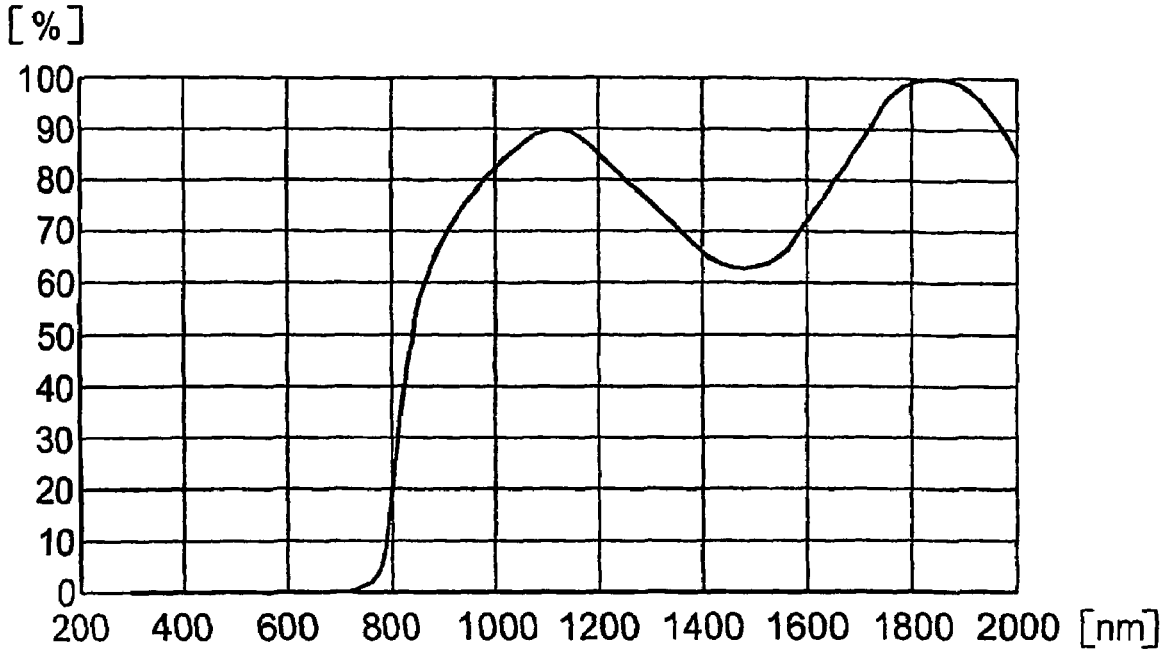
Figure 8:
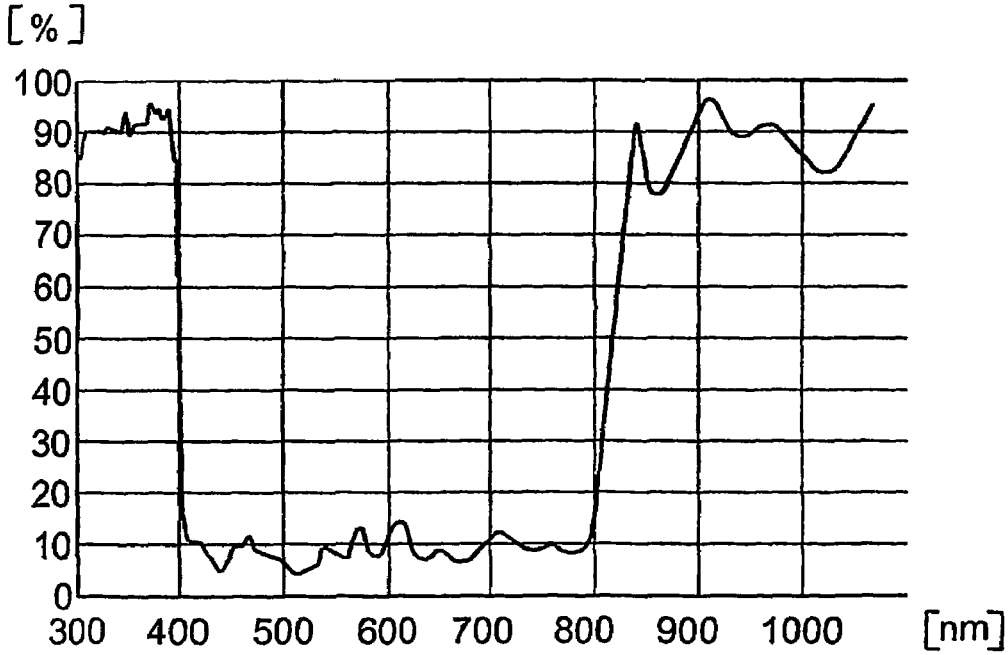
Figure 9:
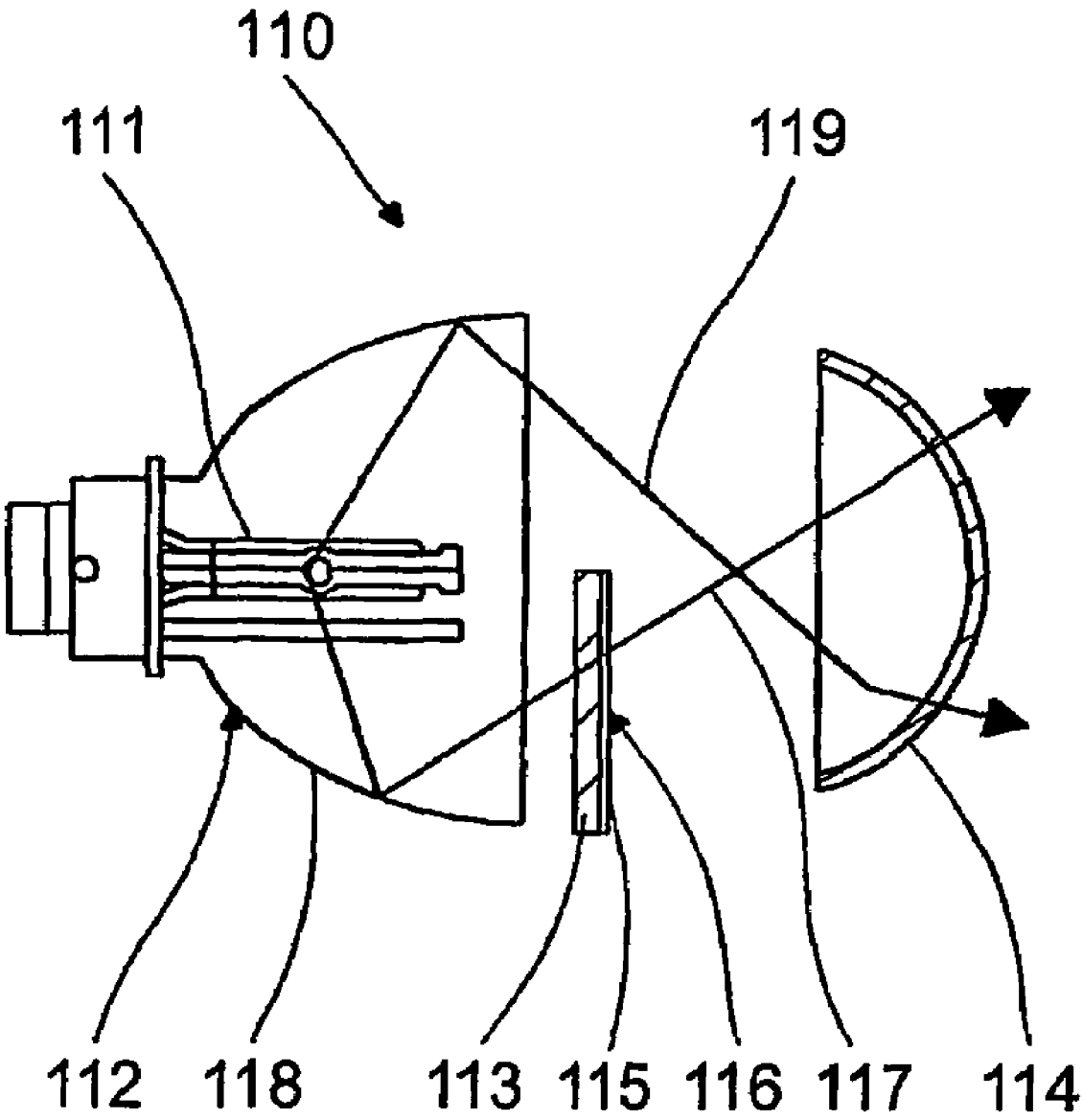

Embodiments of the invention will be explained in more detail below with reference to the drawings, in which:

FIG. 1 shows a single-filament halogen lamp with simultaneous low-beam and IR high-beam functions used in a vehicle headlight in a diagrammatic side elevation, FIG. 2 shows the single-filament halogen lamp inserted into the vehicle headlight in front elevation, FIG. 3 shows a single-filament halogen lamp with simultaneous parking light and IR high-beam functions in side elevation, FIG. 4 shows a dual-filament halogen lamp with a first filament for a low-beam function and a second filament for a simultaneous parking light and IR high-beam function used in a vehicle headlight in a diagrammatic side elevation, FIG. 5 shows a dual-filament halogen lamp with a first filament for simultaneous low-beam and IR high-beam functions and a second filament for a high-beam function inserted into a vehicle headlight in a diagrammatic side elevation, FIG. 6 shows a discharge lamp with simultaneous low-beam and IR high-beam functions inserted into a headlight in a diagrammatic side elevation, FIG. 7 is a diagram for an IR light filter, FIG. 8 is a diagram for an IR and UV light filter, and FIG. 9 shows a headlight with a screen in a diagrammatic side elevation.

FIG. 1 shows a headlight 1 with a reflector 2 and a single-filament halogen lamp 3 which emits visible light and infrared light. An emission of light means a generation and radiation of light. An electrically conducting incandescent filament 5 in the form of a coil is positioned in the interior of a lamp bulb 4. The lamp 3 is arranged in front of the reflector 2, the latter reflecting the visible light and infrared light radiated by the lamp 3 in a defined manner. A first region 6 of the lamp bulb 4 is constructed so as to be at least partly permeable to infrared light and at least partly impermeable to visible light. This function is achieved by a multiple-layer thin-film filter 7 which is provided on an outer surface 8 of the quartz glass lamp bulb 4 in a conventional thin-film coating process. The thin-film filter 7 is a filter coating 7 in the form of a semi-circular shell provided on the bulb 4 and comprises fifteen individual layers, in which a layer of a $Ta_2O_5$ material of high refractive index alternates with an $SiO_2$ material of lower refractive index each time. A second region 9, the uncoated region of the lamp bulb 4 of quartz glass in this case, is wholly or partly permeable to the entire wavelength range of the light, i.e. to visible light and infrared light. Substantially the entire light emission from the lamp bulb 4, in particular in the direction of the reflector 2 of the headlight 1, is realized through said two regions 6 and 9 of the lamp bulb 4.

The lamp bulb 4 has a front region 10 which is covered by an anti-dazzle cap 11. Advantageously, the cap is constructed as an infrared filter which allows IR light to pass and blocks light in the visible wavelength range. The bulb 4 furthermore comprises a pinch region 12 which is substantially covered by a lamp base 13.

A boundary 16 between the regions 6 and 9 on the outer surface 8 of the lamp bulb 4 runs substantially horizontally and in one plane with an axis 17 of the filament 5 when the headlight 1 is in the mounted position. The light issuing from the second region 9 is incident substantially directly on an upper reflector sector 18 of the reflector, which is optimized in a known manner for the low-beam function. A reflector sector 19 facing the thin-film filter 7 reflects the infrared light in a defined manner, i.e. in particular such that a high-beam or long-distance range is irradiated, and the infrared light illuminates that region of the traffic space in front of the vehicle which is not illuminated by the visible low beam and which extends over a horizontal angular range of approximately +/−10°.

Two headlights 1, each capable of generating a low beam and a high beam, form part of a lighting installation of a motor vehicle, which installation in addition comprises a sensor device. A long-distance range detected by the sensor device can be shown on a display device, so that objects in a long-distance range are also visible at night. The two vehicle headlights with low-beam functions radiate visible light into the low-beam region and infrared light into the high-beam region of the traffic space through separate regions of the lamp bulb, said infrared light serving to support the night vision function.

A filter 20 reflecting infrared light at least partly into the lower region 6 is arranged in the upper region 9 of the bulb 4. The infrared light for long distance is intensified thereby.

FIG. 2 shows the vehicle headlight 1 with the lamp 3. The light reflected in the upper reflector sector 18 generates a low beam. The light reflected in the lower reflector sector 19 generates a high beam.

FIG. 3 shows a further single-filament halogen lamp 31 which also provides two different lighting functions for a vehicle, i.e. IR light in the high-beam region for supporting the night vision function and visible light for serving as a parking light. For this purpose, a lamp bulb 32 comprises an infrared filter 34 in a first region 33, which filter 34 is at least partly impermeable to visible light and substantially permeable to infrared light, and a blue-green filter 36 in a region 35, which filter 36 is permeable in particular to blue and green light. Red light in the visible range passes through the infrared filter 34 in an undesired manner, but said light is additively mixed with the blue and green light into white light. Said white light radiates with an intensity such that a parking light can be achieved.

FIG. 4 diagrammatically shows a vehicle headlight 41 for low beam with a dual-filament halogen lamp 42 and a reflector 43. The lamp 42 has a lamp bulb 44 and a lamp base 45. Two incandescent filaments 46 and 47 and a shield 48 of molybdenum below said first, frontmost incandescent filament 46 are positioned inside the lamp bulb 44. The molybdenum shield 48 is impermeable to visible light. A first, central region 49 of the bulb 44 is at least partly permeable to infrared light and at least partly impermeable to visible light. To achieve this, a filter coating 50 is provided on the bulb 44 so as to envelop the bulb 44 in a tubular manner. Undesirably, this region is also permeable to red light in the visible wavelength range. A second, frontmost region 51 of the bulb 44 is free from any coating and permeable to infrared and visible light. A third, rearmost region 52 is designed so as to be permeable to green and blue light. For this purpose, a filter coating 53 is provided on the bulb 44, enveloping the bulb 44 in a tubular manner. This filter coating -53 is bounded by the filter coating 50 and adjoins the lamp base 45. The frontmost region 51 surrounds the first, front incandescent filament 46, while the central and rearmost regions 49 and 52 surround the second, rear incandescent filament 47.

In the low-beam operational state, the two incandescent filaments 46 and 47 are electrically conducting, i.e. switched on, and radiate light both in the visible and in the infrared wavelength range. In this low-beam functional condition, the first, front incandescent filament 46 radiates visible light onto an upper reflector sector 54 and thus produces a low beam. The molybdenum shield 48 prevents visible light from reaching a lower reflector sector 55 and illuminating a long-distance region. The second, rear incandescent filament 47 generates visible and infrared light. The filter coating 50 achieves that only infrared light enters the close range as well as the long-distance range via the two reflector sectors 54 and 55. At the same time, however, undesirable visible red light of low intensity passes through the filter coating 50. The blue-green filter allows blue and green light of low intensity to pass. The blue, green, and red light of low intensity are mixed into a white light. The white light can be used as a parking light of such a low intensity that dazzling of oncoming drivers is made impossible. Should the first, front incandescent filament 46 fail, no low-beam light in the visible range is generated anymore. The vehicle headlight 41 nevertheless provides a parking light, thus forming a demarcation light 41. The motor vehicle is still recognizable to oncoming drivers as a four-wheel wide motor vehicle.

FIG. 5 shows a vehicle headlight 61 with a further dual-filament halogen lamp 62. Two incandescent filaments 64 and 65 and a shield 66 below the first, front incandescent filament 64 are positioned inside a lamp bulb 63 of the dual-filament halogen lamp 62. The shield 66 is at least partly permeable to infrared light and at least partly impermeable to visible light and is formed substantially of quartz glass with a filter coating 67 of several layers, in which a layer of a $Ta_2O_5$ material of high refractive index and a layer of $SiO_2$ material of lower reflective index alternate each time. In the low-beam operational condition, only the first, front incandescent filament 64 is switched on and radiates light. Visible light and infrared light are radiated through an upper bulb region 68 into an upper reflector sector 69 of a reflector 70 designed for a low beam. Visible light and infrared light are radiated into a lower bulb region 71, where the visible light is filtered out to a high degree by the filter coating 67, so that substantially only infrared light enters a lower reflector sector 72, where an infrared high beam is generated. In the high-beam operational condition, the rear incandescent filament 65 only is switched on, radiating infrared and visible light as a high beam into a long-distance range via the two reflector sectors 69 and 72.

FIG. 6 shows a headlight 79 with a reflector 80 and a high-pressure gas discharge lamp 81. The lamp comprises a lamp base 82, an inner quartz glass lamp vessel 83 closed in a vacuumtight manner, and an outer lamp bulb 84 of quartz glass. The lamp vessel 83 comprises in mutual opposition a first and a second neck-shaped portion 85 and 86, through which current supply conductors 87 and 88 lead to a pair of electrodes 89 and 90. The first neck-shaped portion 85 is fixed in the lamp base 82. A support, 91 serves to guide the second current supply conductor 88 and supports a casing 92 in which the second neck-shaped portion 86 is fixed. The current supply conductors 87 and 88 are passed through the lamp base 82 and are connected to electrically conductive pins 93 that extend to the exterior. The lamp vessel 83 comprises an ionizable filling of xenon, mercury, and metal halides. The bulb 84 has a region 94 with a coating 95 which is at least partly permeable to infrared light and at least partly impermeable to visible light. The coating 95 envelops the bulb 84 at least partly, and two strips 96 of the coating 95 extend along a bulb axis 97 in a lower half 98 of the bulb 84. This coating 95 prevents light in the visible wavelength range from hitting a lower reflector sector 99 and thus generating a high beam in the visible wavelength range. The coating 95 is a thin-film filter 95 with fifteen individual layers, alternating between a layer of a $Ta_2O_5$ material of high refractive index and a layer of an $SiO_2$ material of lower refractive index each time. Undesirably, however, the coating 95 is also slightly permeable to red light in the visible wavelength range. Infrared light does pass through this coating 95 and is reflected by the lower-reflector sector 99. A high beam is generated with this infrared light, irradiating the long distance. The long-distance range can be displayed by means of a night vision apparatus. Light in the visible wavelength range is radiated from a second region 101, serving to generate a low beam and illuminating a short-distance range with visible light.

FIG. 7 is a diagram showing the permeability in percents plotted against the wavelength in nanometers for a second coating 95. Visible light covers a range of 380 to 780 nm. Adjacent infrared light lies in a region from 780 to 5000 nm. The permeability of said second coating is low in the visible wavelength range and high in the IR range. This second coating 95, which performs the same function as the one indicated above, comprises a total of twelve layers, i.e. starting from a lamp bulb surface 96 a first, 38.82 nm thick layer of $Fe_2O_3$, then a second, 99.9 nm thick layer of $SiO_2$, then a third, 47.06 nm thick layer of $Fe_2O_3$, a fourth, 102.39 nm thick layer of $SiO_2$, a fifth, 228.8 nm thick layer of $Fe_2O_3$, a sixth, 97.78 nm thick layer of $SiO_2$, a seventh, 58.95 nm thick layer of $Fe_2O_3$, an eighth, 100.39 nm thick layer of $SiO_2$, a ninth 52.29 nm thick layer of $Fe_2O_3$, a tenth, 97.97 mm thick layer of $SiO_2$, an eleventh, 223.1 nm thick layer of $Fe_2O_3$, and a twelfth, 194.75 nm thick layer of $SiO_2$. These layers are provided on the surface 100 of the bulb 84 in a chemical vapor deposition (CVD) process. For this purpose, the bulb 84 is positioned in a reactor together with starting materials that can be vaporized or are in the gaseous state. Particles of the starting materials are ionized and deposit themselves on the bulb surface, reacting on the surface with one another so as to form the $Ta_2O_5$, $SiO_2$, or $Fe_2O_3$ layers. An alternative coating method is physical vapor deposition (PVD).

FIG. 8 is a diagram showing the permeability in percents plotted against the wavelength in nanometers for a third coating 95. The filter 95 is permeable both to UV and to IR light and blocks visible light. UV light, i.e. ultraviolet radiation, lies in a wavelength range below 380 nm. This filter comprises, starting from a lamp bulb surface, a first, 118.62 nm thick layer of $SiO_2$, a second, 84.02 nm thick layer of $ZrO_2$, a third, 124.00 nm thick layer of $SiO_2$, a fourth, 80.69 nm thick layer of $ZrO_2$, a fifth, 121.91 nm thick layer of $SiO_2$, a sixth, 90.78 nm thick layer of $ZrO_2$, a seventh, 129.54 nm thick layer of $SiO_2$, an eighth, 93.00 nm thick layer of $ZrO_2$, a ninth, 126.78 nm thick layer of $SiO_2$, a tenth, 87.43 nm thick layer of $ZrO_2$, an eleventh, 106.93 nm thick layer of $SiO_2$, a twelfth, 73.13 nm thick layer of $ZrO_2$, a thirteenth, 119.15 nm thick layer of $SiO_2$, a fourteenth, 72.77 nm thick layer of $ZrO_2$, a fifteenth, 87.44 nm thick layer of $SiO_2$, a sixteenth, 59.97 nm thick layer of $ZrO_2$, a seventeenth, 82.66 nm thick layer of $SiO_2$, an eighteenth, 72.02 nm thick layer of $ZrO_2$, a nineteenth, 127.92 nm thick layer of $SiO_2$, a twentieth, 67.66 nm thick layer of $ZrO_2$, a twenty-first, 83.18 nm thick layer of $SiO_2$, a twenty-second, 54.61 nm thick layer of $ZrO_2$, a twenty-third, 78.57 nm thick layer of $SiO_2$, a twenty-fourth, 53.80 nm thick layer of $ZrO_2$, a twenty-fifth, 78.42 nm thick layer of $SiO_2$, a twenty-sixth, 53.96 nm thick layer of $ZrO_2$, a twenty-seventh, 75.19 nm thick layer of $SiO_2$, a twenty-eighth, 56.58 nm thick layer of $ZrO_2$, a twenty-ninth, 81.74 nm thick layer of $SiO_2$, a thirtieth, 58.64 nm thick layer of $ZrO_2$, a thirty-first, 122.46 nm thick layer of $SiO_2$, a thirty-second, 9.29 nm thick layer of $ZrO_2$, and a thirty-third, 511.25 nm thick layer of $SiO_2$.

FIG. 9 shows a headlight 110 with a discharge lamp 111, a reflector 112, a screen 113, and a lens 114. The screen 113 is at least partly permeable at least to infrared light and UV light and at least partly impermeable to visible light. For this purpose, the screen of quartz glass has a region 115 with a filter coating 116. An IR and UV high beam 117 can be generated thereby via a lower reflector sector 118, while at the same time a low beam 119 of visible light is made possible.

The invention claimed is:

1. A headlight comprising:

a light source for providing source light including visible light, UV light and infrared light;

a reflector configured to reflect said source light, said reflector having an upper sector for reflecting said source light downward to form a low beam, and a lower sector for reflecting said source light upward to form a high beam, said high beam having a higher direction than said low beam; and a screen configured to receive said high beam from said lower sector and to substantially pass said UV light and said infrared light and block said visible light.

2. A headlight comprising:

a light source for providing source light including visible light and infrared light;

a reflector configured to reflect said source light, said reflector having an upper sector for reflecting said source light downward to form a low beam, and a lower sector for reflecting said source light upward to form a high beam, said high beam having a higher direction than said low beam; and a screen configured to receive said high beam from said lower sector and to substantially pass said infrared light and block said visible light.

3. A lamp radiating visible light and infrared light, having a lamp bulb comprising:

at least a first region which is at least partly permeable to infrared light and at least partly impermeable to visible light, and at least a second region which is permeable to blue and green light only.

4. The lamp from claim 3, further comprising a third region which is wholly or partly permeable at least to the visible light.

5. The lamp from claim 4, wherein one of said two filaments is in a third region.

6. The lamp from claim 3, wherein said lamp bulb includes two filaments.

7. The lamp from claim 3, wherein the second region is closer to a base of the lamp than the first region.

* * * * *